United States Patent [19]

Pohl et al.

[11] Patent Number: 5,058,534

[45] Date of Patent: Oct. 22, 1991

[54] PIPE WALL OF HOT REACTION CHAMBERS

[75] Inventors: Hans-Christoph Pohl, Witten; Klaus Köhnen, Mülheim/Ruhr, both of Fed. Rep. of Germany

[73] Assignee: Krupp Koppers GmbH, Essen, Fed. Rep. of Germany

[21] Appl. No.: 571,294

[22] Filed: Aug. 17, 1990

[30] Foreign Application Priority Data

Aug. 28, 1989 [DE] Fed. Rep. of Germany ..... 3928371

[51] Int. Cl.[5] ..... F22B 21/34

[52] U.S. Cl. ..... 122/6 A; 165/168; 165/169

[58] Field of Search ..... 165/168, 171, 169; 122/6 A, 6 R

[56] References Cited

U.S. PATENT DOCUMENTS

| | | | |
|---|---|---|---|
| 1,732,514 | 10/1929 | Hunter | 122/6 A |
| 2,053,127 | 9/1936 | Biggs | 122/6 A |
| 2,149,008 | 2/1939 | Chapman et al. | 122/6 A |
| 2,236,186 | 3/1941 | Murray, Jr. | 122/6 A |
| 2,267,027 | 12/1941 | Hardgrove | 122/6 A |
| 2,391,108 | 12/1945 | Trainer | 165/168 |
| 4,135,575 | 1/1979 | Gersch | 122/6 A |

FOREIGN PATENT DOCUMENTS

| | | | |
|---|---|---|---|
| 493444 | 10/1938 | United Kingdom | 122/6 A |
| 545155 | 5/1942 | United Kingdom | 122/6 A |

*Primary Examiner*—Albert W. Davis, Jr.

[57] ABSTRACT

A pipe wall for hot reaction chambers comprises a plurality of pipes which together define a side to be heat loaded, and a plurality of holding elements arranged on the heat-loaded side for holding a temperature resistant coating. The pipes on the heat-loaded side together forming a substantially flat surface.

11 Claims, 1 Drawing Sheet

PIPE WALL OF HOT REACTION CHAMBERS

BACKGROUND OF THE INVENTION

The present invention relates to a pipe wall for hot reaction chambers. More particularly, it relates to such a pipe wall which is provided with a temperature-resistant ceramic coating held on its heat-loaded side by metallic holding elements.

In hot reaction chambers, such as for example refractory chamber or reaction chambers of coal gasifiers, high temperatures occur, which are required for the desired reactions and/or for a liquid slack withdrawal. As a rule, it is required to provide the pipe walls of the hot reaction chambers with a corresponding temperature-resistant ceramic coating. For holding and cooling of the ceramic coating, the pipe walls of the hot reaction chambers are conventionally provided with pins mounted by means of the light arc welding. A maximum pin density which can be achieved is approximately 3,000 pins per $m^2$. The service life of the ceramic coating is of decisive importance for the efficiency of the hot reaction chambers and therefore of the total installation. These depend substantially on the cooling action, applied to the ceramic coating by the pipe wall through which the cooling medium flows.

SUMMARY OF THE INVENTION

Accordingly, it is an object of the present invention to provide a pipe wall for a heat reaction chamber of the above mentioned general type, which provides for an intensive cooling of the ceramic coating and thereby a longer service life than with the known pipe walls.

The present invention is based on the recognition that the heat withdrawal or the cooling action is more efficient with the increase in the ratio of the heat-withdrawing surface to the heat-receiving surface.

With this recognition, the present invention proposes such a pipe wall in which the heat-loaded side of the pipe wall is formed substantially as a flat surface. The heat-loaded flat side of the pipe wall, or in other words, the heat-receiving surface, is naturally significantly smaller than the heat-loaded side of known pipe walls in which this surface is formed by curves of the neighboring pipes having circular cross-sections. This means that the ratio of the heat-withdrawing surface to the heat-receiving surface in the inventive pipe wall is relatively high. As a result, the specific heat withdrawal is more intensive and the service life of the ceramic coating applied to the pipe wall is increased.

The pipe wall in accordance with the present invention can be formed in accordance with several embodiments. It is possible to use the pipes formed as shaped pipes with flat surfaces facing toward the heat-loaded side of the wall.

It is also possible to use the individual pipes of normal circular cross-section with flattened surfaces facing toward one another. The depressions formed at the flat heat-loaded side of the wall between the individual pipes are filled in this case by welding layers.

Holding elements for the ceramic coating at the flat heat-loaded side of the pipe wall can be welded in a known manner and formed as pins. In accordance with a further proposal of the invention, also holding elements formed as ribs can be provided on the flat side.

The ribs can be formed with bulges and/or recesses for increasing their adherence to the ceramic coating. The adherence is further improved when the ribs are cut and bent away at the side facing away of the pipe wall.

For providing a long-time mounting of the ribs on the pipe wall, it is proposed in accordance with the present invention to provide the ribs with a build-up welding at the welding side and to make this welding of the same material which welds the pipes with one another.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
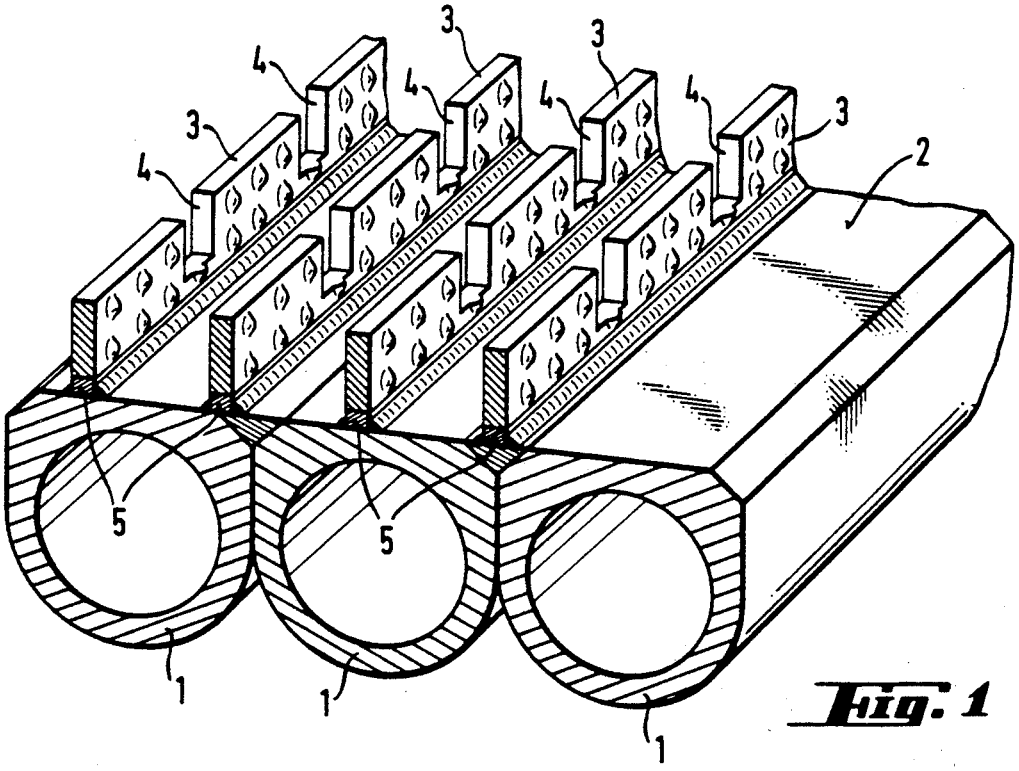
FIG. 1 is a view showing a pipe wall in accordance with one embodiment of the present invention.

A pipe wall in accordance with the first embodiment as shown in FIG. 1 is assembled of shaped pipes 1 having flat surfaces 2. The shaped pipes are welded with one another in a gas-tight manner. The flat surfaces of the welded shaped pipes together form a flat heat-loaded side of the pipe wall in accordance with the present invention. The flat heat-loaded side is provided with a plurality of ribs 3. The ribs 3 are formed as buckle plates for holding a not shown ceramic lining and welded to the flat heat-loaded side. The ribs 3 are provided with recesses 4. Welds that connect the ribs to the flat heat-loaded side of the pipe wall are identified with reference numeral 5.

Figure 2:
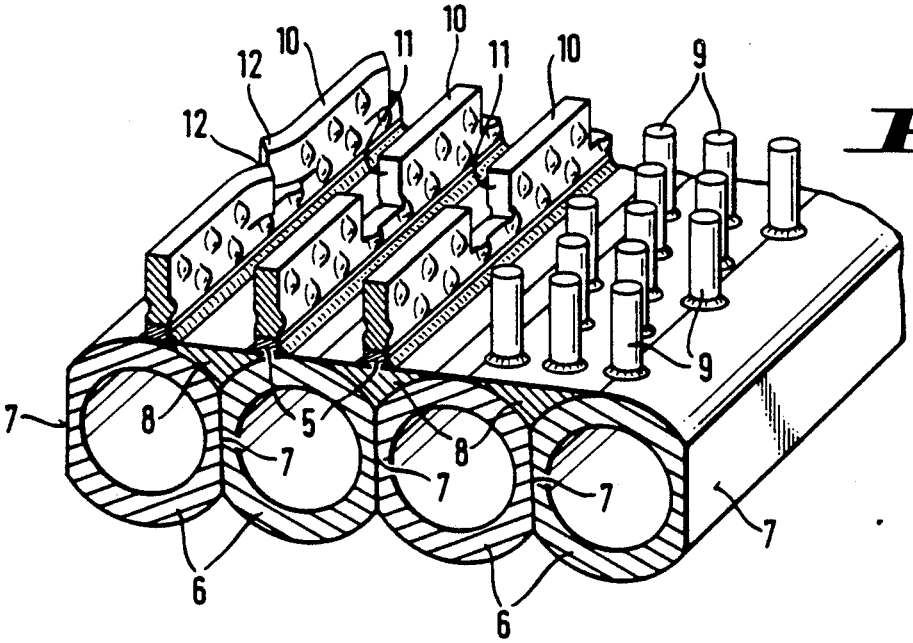
FIG. 2 is a view showing a pipe wall in accordance with a second embodiment of the present invention.

The pipe wall in accordance with the embodiment shown in FIG. 2 is assembled of normal pipes 6 with a circular cross-section. Their surfaces 7 which abut against one another are flattened by a respective machining for example by milling. As a result, the cross-section of the depressions between the pipes is reduced. The reduced cross-section spaces between the pipes are filled with welding layers and identified with reference numeral 8. Here also a flat heat-loaded surface of the pipe wall is formed. Pins 9 are shown in the right part of FIG. 2. They serve for holding of the not shown ceramic coating. Ribs 10 provided in the left part of FIG. 2 also serve the purpose of holding the ceramic coating. Ribs 10 can be provided with recesses 11, similarly to the ribs of FIG. 1. On the other hand, the ribs can be cut and then bent away as identified with reference numeral 12.

It will be understood that each of the elements described above, or two or more together, may also find a useful application in other types of constructions differing from the types described above.

While the invention has been illustrated and described as embodied in a pipe wall for hot reaction chambers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A pipe wall for hot reaction chambers, comprising a plurality of pipes welded with one another to form a substantially flat surface defining a heat-loaded side of said pipe wall; and a plurality of metallic holding elements welded to said substantially flat surfaces for retaining a ceramic coating thereon.

2. A pipe wall as defined in claim 1, wherein said plurality of metallic holding elements comprises a plurality of ribs formed by build-up welding of a same material welds connecting said plurality of pipes are formed of.

3. A pipe wall as defined in claim 1, wherein said pipes are formed as shaped pipes each having a flat surface facing toward the head-loaded side.

4. A pipe wall as defined in claim 1, wherein said pipes have circular cross-sections and surfaces which face toward one another and are flat.

5. A pipe wall as defined in claim 4, wherein said pipes form with one another depressions at the flat heat-loaded side, said depressions being filled with a welding material for welding said pipes with one another.

6. A pipe wall as defined in claim 1, wherein said holding elements are formed as pins on the flat heat-loaded side.

7. A pipe wall as defined in claim 1, wherein said holding elements are formed as ribs provided on the flat heat-loaded side.

8. A pipe wall as defined in claim 7, wherein said ribs are provided with bulges.

9. A pipe wall as defined in claim 7, wherein said ribs are provided with recesses.

10. A pipe wall as defined in claim 7, wherein said ribs have a side which faces away of said pipes and are cut and bent at said side facing away of said pipes.

11. A pipe wall as defined in claim 5, wherein said pipes are connected with one another by a welding material, said ribs being connected with said pipes by the same welding material.

* * * * *